US007261334B2

(12) United States Patent
Oberheide et al.

(10) Patent No.: US 7,261,334 B2
(45) Date of Patent: Aug. 28, 2007

(54) POWER RELEASE ACTUATOR

(75) Inventors: G. Clarke Oberheide, Troy, MI (US); Gregory A. Jorgensen, Oxford, MI (US); John G. Zeabari, Highland, MI (US); Thomas L. McGettrick, Plymouth, MI (US)

(73) Assignee: Intier Automotive Closures Inc., Newmarket, Ontario (CA)

( * ) Notice: Subject to any disclaimer, the term of this patent is extended or adjusted under 35 U.S.C. 154(b) by 0 days.

(21) Appl. No.: 10/873,789

(22) Filed: Jun. 22, 2004

(65) Prior Publication Data

US 2005/0184534 A1 Aug. 25, 2005

(51) Int. Cl.
*E05C 3/06* (2006.01)

(52) U.S. Cl. ..... 292/201; 292/216; 292/DIG. 23

(58) Field of Classification Search ..... 292/201, 292/210, 216, DIG. 22, DIG. 23, DIG. 65
See application file for complete search history.

(56) References Cited

U.S. PATENT DOCUMENTS

| | | | | |
|---|---|---|---|---|
| 4,569,544 | A | 2/1986 | Escaravage | |
| 5,639,130 | A * | 6/1997 | Rogers et al. | 292/201 |
| 5,769,468 | A | 6/1998 | Armbruster | |
| 5,918,917 | A * | 7/1999 | Elton et al. | 292/201 |
| 6,053,543 | A * | 4/2000 | Arabia et al. | 292/201 |
| 6,076,868 | A * | 6/2000 | Roger et al. | 292/201 |
| 6,131,337 | A * | 10/2000 | Machida | 292/201 |
| 6,131,967 | A | 10/2000 | Kondo et al. | |
| 6,145,354 | A | 11/2000 | Kondo et al. | |
| 6,223,468 | B1 | 5/2001 | Kobayashi | |
| 6,328,353 | B1 | 12/2001 | Barczynski et al. | |
| 6,386,599 | B1 | 5/2002 | Chevalier | |
| 6,390,516 | B1 | 5/2002 | Kobayashi | |
| 6,499,776 | B2 | 12/2002 | Takamura | |
| 6,505,867 | B1 | 1/2003 | Szablewski et al. | |
| 6,568,720 | B1 * | 5/2003 | Szablewski | 292/201 |
| 6,575,507 | B2 * | 6/2003 | Reddmann | 292/201 |
| 6,848,727 | B1 * | 2/2005 | Cetnar et al. | 292/201 |
| 2001/0005078 | A1 | 6/2001 | Fukushima et al. | |
| 2001/0005079 | A1 | 6/2001 | Takamura | |
| 2002/0096889 | A1 | 7/2002 | Nelsen et al. | |
| 2002/0117862 | A1 * | 8/2002 | Yamauchi et al. | 292/201 |
| 2002/0117863 | A1 | 8/2002 | Shinkawa | |
| 2002/0158475 | A1 | 10/2002 | Rice et al. | |
| 2002/0167179 | A1 | 11/2002 | Takamura | |
| 2003/0038485 | A1 | 2/2003 | Schwaiger et al. | |
| 2003/0067175 | A1 | 4/2003 | Shiota et al. | |

FOREIGN PATENT DOCUMENTS

| | | | |
|---|---|---|---|
| WO | WO/0049252 | * | 2/2000 |

* cited by examiner

*Primary Examiner*—Suzanne Dino Barrett
*Assistant Examiner*—Christopher Boswell
(74) *Attorney, Agent, or Firm*—Clark Hill PLC

(57) ABSTRACT

A method as disclosed for operating a motor bidirectionally to cinch and release a closure panel of a motor vehicle. The motor is operatively connected to a pawl, ratchet and spring of a latch for the closure panel. The method includes the step of driving the motor in a cinching direction to rotate the ratchet to cinch the closure panel in the closed position. The motor is then returned to a park position by driving the motor in a park direction opposite to the cinching direction. Power is applied to the motor to drive the motor in a release direction to drive the motor past the park position with respect to the cinching direction. In doing so, the motor contracts the spring as it moves in the release direction. Power is then removed from the motor allowing the spring to force the motor to return to the park position as the spring returns to its steady state position.

6 Claims, 5 Drawing Sheets

POWER RELEASE ACTUATOR

FIELD OF THE INVENTION

The invention relates to a power release actuator for a closure panel of a motor vehicle. More particularly, the invention relates to an actuating assembly for actuating a latch to cinch and release a striker secured to a closure panel of a motor vehicle.

DESCRIPTION OF THE RELATED ART

Closure panels such as liftgates and tailgates are commonly powered to automatically open and close by turning on and off a motor-driven mechanism. These automated devices typically close the closure panel and seal the closure panel against the opening to the motor vehicle compartment. Each of these functions can be broken down into two sub-functions. With regard to the movement of the closure panel from the closed position to the open position, the striker bar, that is secured to the closure panel, must be released. Secondly, the closure panel must be moved from its closed position to the open position. With regard to the closing of the closure panel, the automated system must move the closure panel from its fully open position to a closed position. The second function in the closure function is the step of capturing and cinching the striker bar to effect a proper seal of the closure panel over the opening in the motor vehicle.

When the closure panel is a side door, the motor-driven mechanism is only required to perform the second function. More specifically, the motor-driven mechanism is designed to cinch the striker bar to effect a proper seal.

To date, these automated systems include the use of an electromagnetic clutch. Electromagnetic clutches are high cost components and it is a desire to remove the electromagnetic clutch from the systems to reduce the cost. Typically, a clutch is used in the cinching latch wherein it electrically engages the actuator-drive to the latch and disengages upon power down. An electric control synchronizes the operation of the actuator-drive to the clutch. An advantage of using an electromagnetic clutch is that during power loss, and manual operation, lost motion may be designed into the system to allow the movement of the closure panel without actuation of the motor or the electromagnetic clutch.

SUMMARY OF THE INVENTION

A method is disclosed for operating a motor bidirectionally to cinch and release a closure panel of a motor vehicle. The motor is operatively connected to a pawl, ratchet and spring of a latch for the closure panel. The method includes the step of driving the motor in a cinching direction to rotate the ratchet to cinch the closure panel in the closed position. The motor is then returned to a park position by driving the motor in a park direction opposite to the cinching direction. Power is applied to the motor to drive the motor in a release direction to drive the motor past the park position with respect to the cinching direction. In doing so, the motor contracts the spring as it moves in the release direction. Power is then removed from the motor allowing the spring to force the motor to return to the park position as the spring returns to its steady state condition.

BRIEF DESCRIPTION OF THE DRAWINGS

Advantages of the invention will be readily appreciated as the same becomes better understood by reference to the following detailed description when considered in connection with the accompanying drawings wherein.

DETAILED DESCRIPTION OF THE PREFERRED EMBODIMENT

Figure 1:
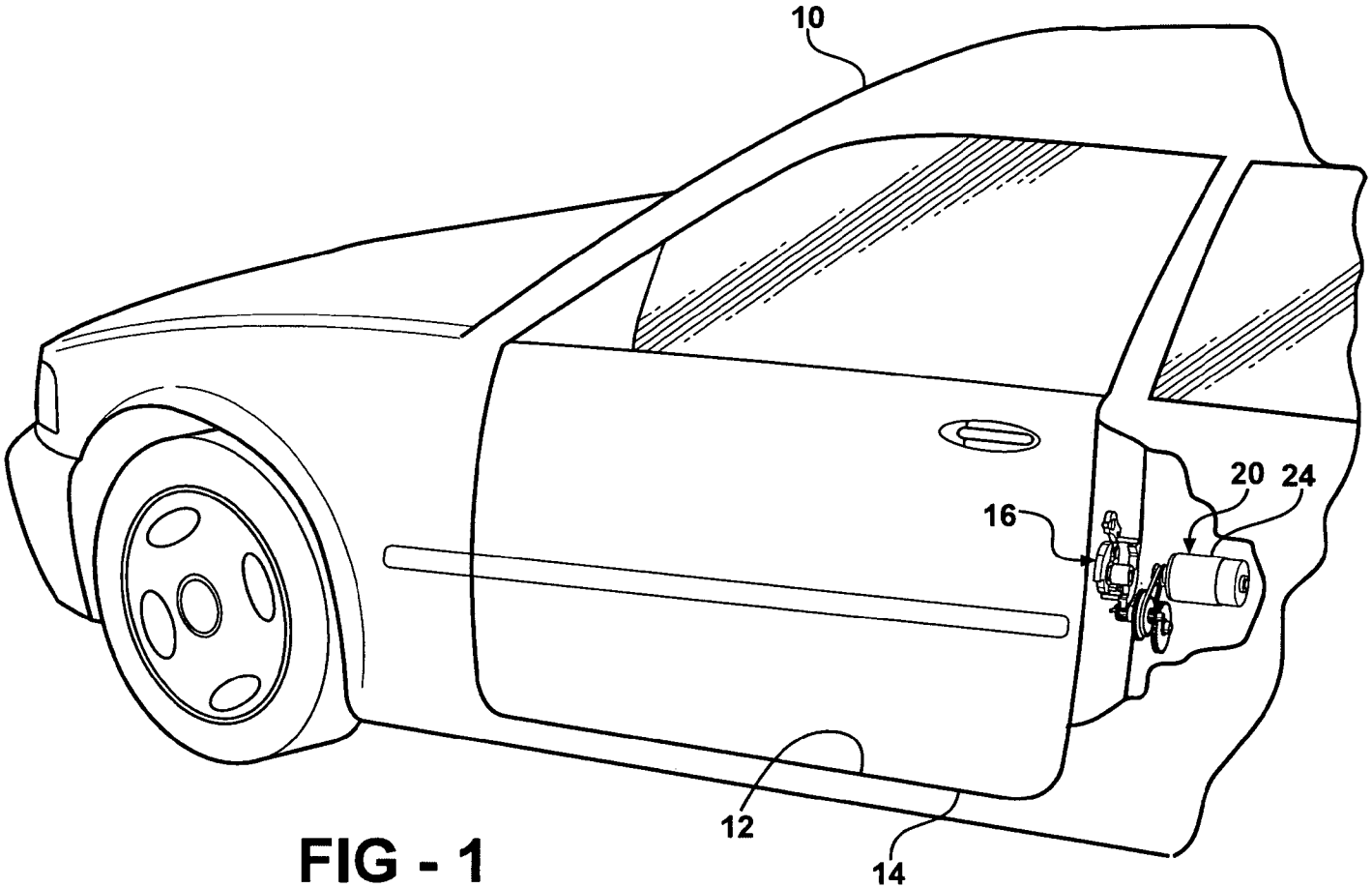
FIG. 1 is a perspective view of a motor vehicle, partially cut away, incorporating one embodiment of the invention.
Figure 2:
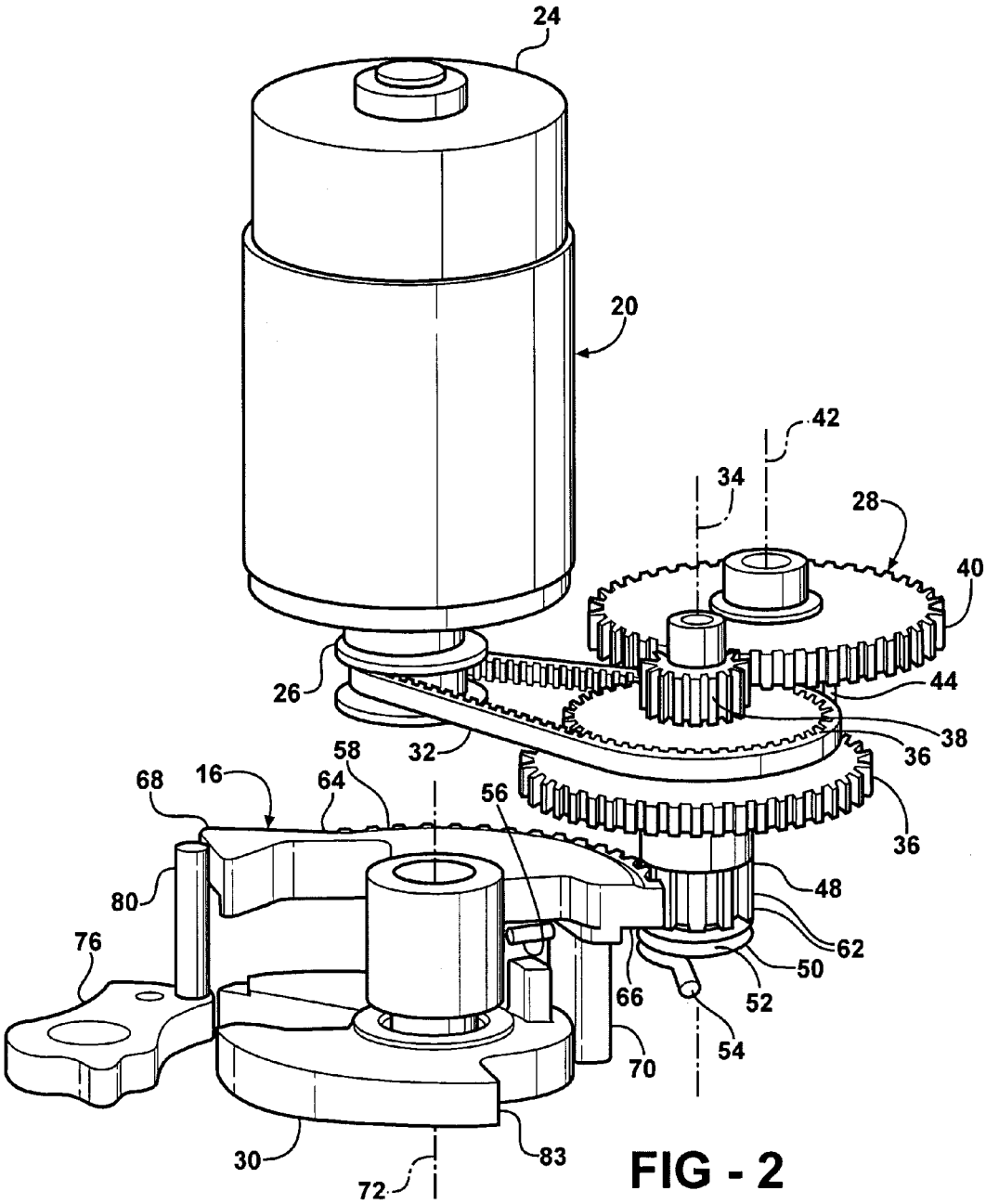
FIG. 2 is a perspective view of a motor driven mechanism utilizing the invention.

Referring to the Figures, a motor vehicle is shown at 10. The motor vehicle 10 includes an opening 12 to a passenger compartment or a storage compartment. A closure panel 14 selectively opens and closes the opening 12. While the closure panel 14 is shown as a side door, it is also contemplated that the closure panel 14 may be a liftgate, a tailgate, a trunk decklid and the like. The closure panel 14 moves between a closed position and a fully open position. A latch, generally indicated at 16, latches the closure panel 14 in the closed position by engaging and retaining a striker bar 18 that is fixedly secured to the closure panel 14.

An actuating assembly, generally indicated at 20, actuates the latch 16 to cinch and release the striker bar 18. The actuating assembly includes a housing that is fixedly secured to a mounting plate. The mounting plate is fixedly secured to the latch 16. The actuating assembly 20 is designed to move components of the latch 16 (discussed subsequently) to allow the latch 16 to release the striker bar 18 of the closure panel 14 and to engage it and cinch the striker bar 18 to secure the closure panel 14 in the closed position.

The actuating assembly 20 includes a motor 24. The motor 24 is electrically driven such that it can produce a rotational force as an output in two directions. The motor 24 is fixedly secured to the housing which is, in turn, fixedly secured relative to the motor vehicle 10. The motor 24 includes an output shaft 26 that extends into the housing 20. As was stated above, the output shaft 26 is drivable in first and second directions from a park position. The park position of the motor 24 is defined as the position in which the motor 24 returns upon its completion of cinching or latching the striker bar 18.

A transmission, generally shown at 28, receives the rotational force provided by the motor 24 and conveys that force to the latch 16 for the eventual rotational movement of a ratchet 30 of the latch 16. The transmission 28 is connected to the output shaft 26 of the motor 24 via a belt 32. The belt 32 is used to provide a freedom in the location of the motor 24 with respect to the first axis of rotation 34 of the transmission 28. In addition, the belt 32 provides noise dampening qualities that enable the actuating assembly 20 to operate in a manner which is quieter by absorbing vibrations between the motor 24 and the transmission 28.

The belt 32 is wrapped around a gear 36, which rotates about the first axis of rotation 34, to rotate a first gear 38. The first gear 38 is connected to a second gear 40, which rotates about a second axis of rotation 42. Below the second gear 40 is a third gear 44. The third gear 44 is fixedly secured to the second gear 40 such that both rotate about the second axis of rotation 42 without lost motion therebetween.

The third gear 44 is engaged with a fourth gear 46. The fourth gear 46 rotates about the first axis of rotation 34 independently of the gear 36. Therefore, the fourth gear 46 rotates about the first axis of rotation 34 independently of the gear 36 and the first gear 38. The fourth gear 46 rotates a fifth gear 48.

Figure 3:
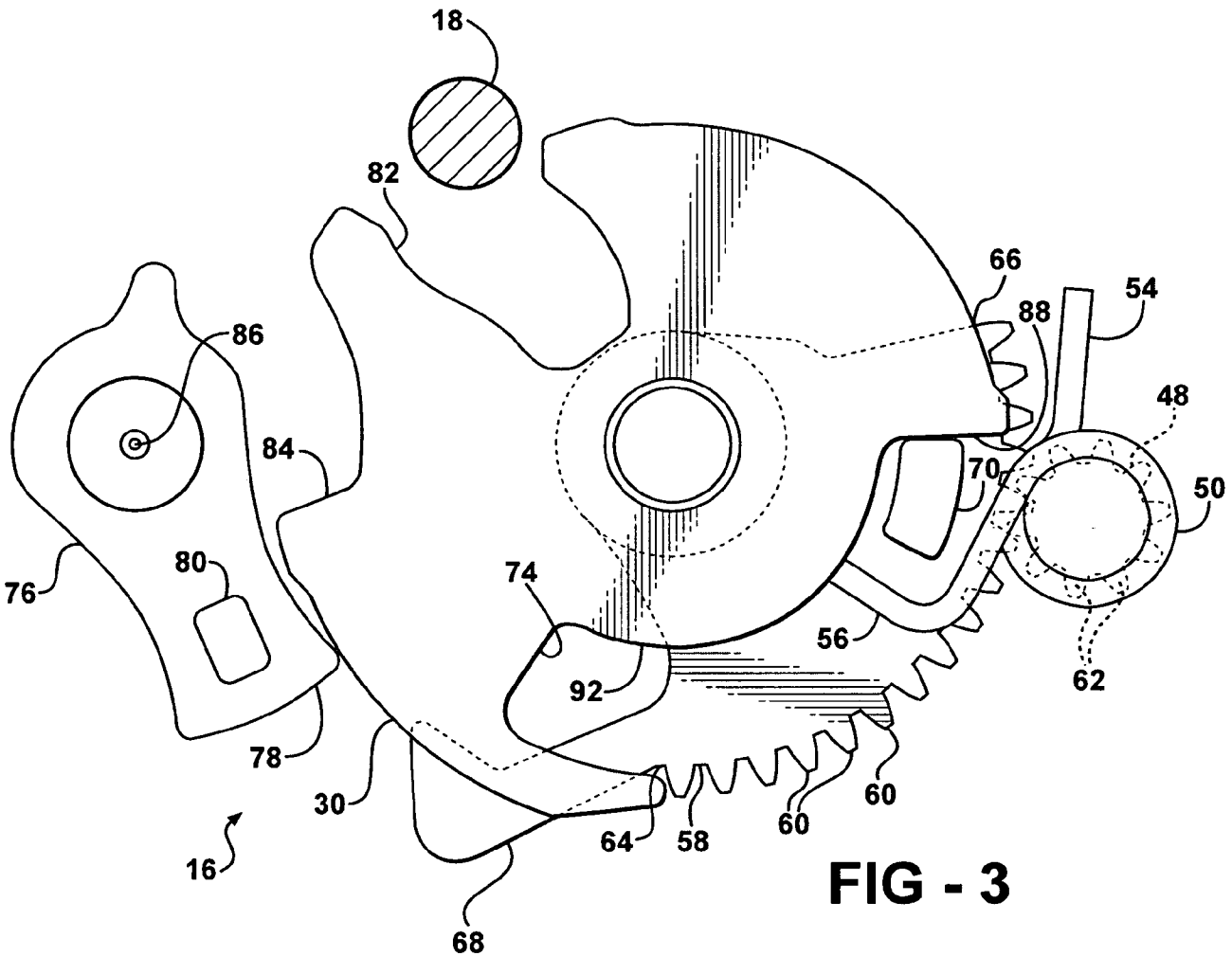
FIG. 3 is a top view of a ratchet and pawl of a latch driven by the motor driven mechanism with a striker bar in a released state.
Figure 4:
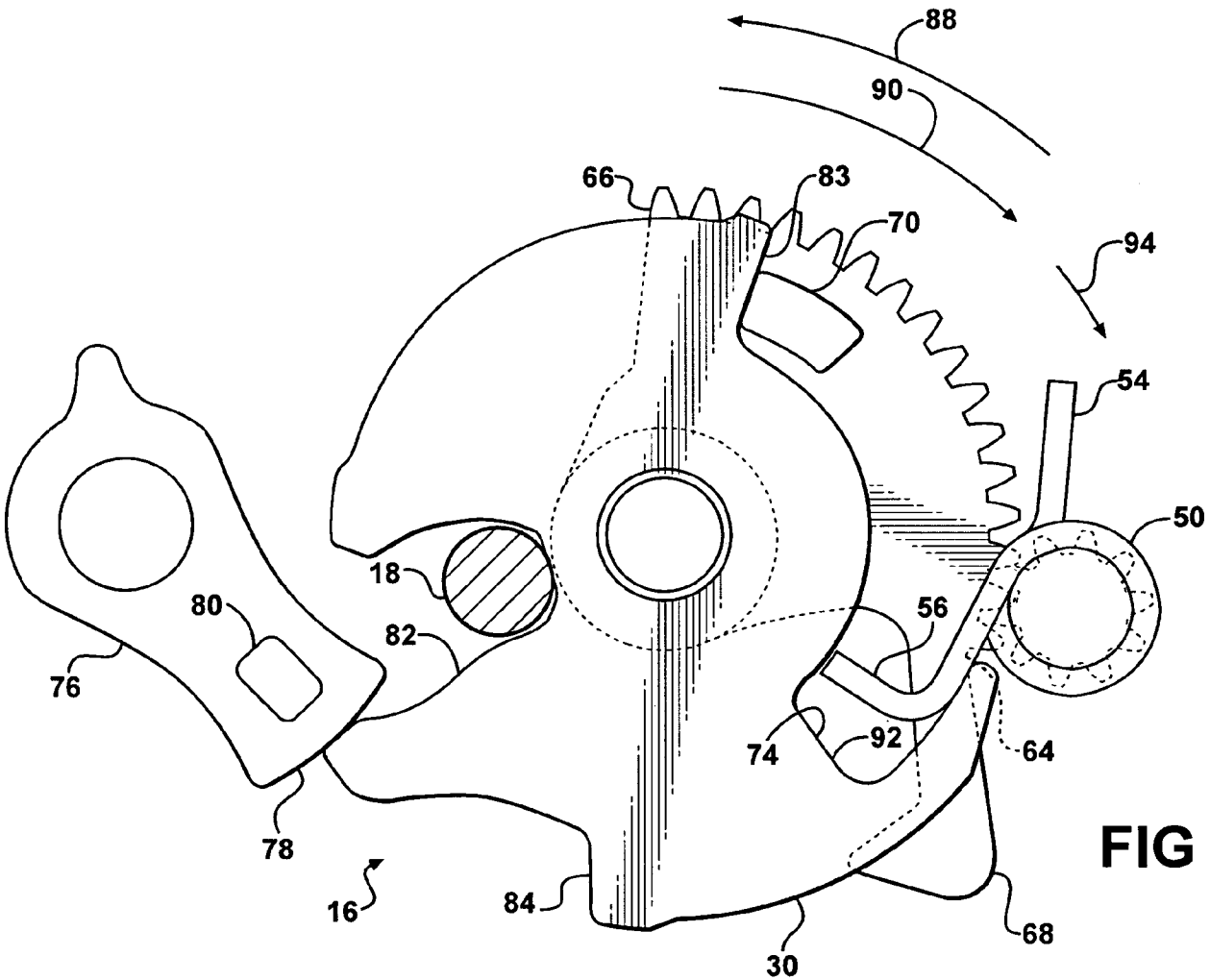
FIG. 4 is a top view of the ratchet and pawl of the latch driven by the motor driven mechanism with the striker bar secured by the ratchet and the pawl locking the ratchet and FIG. 5 is a top view of the ratchet and pawl of the latch driven by the motor driven mechanism with the pawl being moved to release the ratchet and the striker bar.

A spring 50 is positioned to operate about the first axis of rotation 34. The spring 50 is disposed below the fifth gear 48 and has a coil 52 with first 54 and second 56 ends. It is the fifth gear 48 and the spring 50 that engage and operate the latch 16. The spring 50 is shown in a steady state condition in FIGS. 3 and 4.

The latch 16 includes a sector gear 58. The fifth gear 48 operates on the sector gear 58. The sector gear 58 has teeth 60 on its outer periphery that engage teeth 62 of the fifth gear 48. The teeth 60 of the sector gear 58 and the teeth 62 of the fifth gear 48 are designed to be back driven. Therefore, the fifth gear 48 and the sector gear 58 are spur gears which allows them to be driven in both directions.

The sector gear 58 extends between a circumferential first end 64 and a second end 66. The first end 64 of the sector gear includes a tangential extension 68. The second end 66 of the sector gear 58 includes an axial drive pin 70. The sector gear 58 rotates about a third axis of rotation 72 which is common with the axis of rotation of the ratchet 30.

The drive pin 70 extends downwardly from a portion of the sector gear 58 perpendicularly thereto. The drive pin 70 engages the ratchet 30 at a drive surface 74. When the sector gear 58 is moved in an opposite direction, discussed substantially, the drive pin 70 engages the second end 56 of the spring 50 and forces the spring 50 to expand.

The latch 16 also includes a pivotally mounted pawl 76 having an abutment surface 78 and a release pin 80, which extends upwardly from the pawl 76. The abutment surface 78 of the pawl 76 engages a primary detent 82 on the outer periphery of the ratchet 30. The abutment surface 78 of the pawl 76 is designed to engage either the primary detent 82 or a secondary detent 84, both of which extend inwardly toward a center of the ratchet 30. The pawl 76 rotates about a fourth axis of rotation 86. The release pin 80 is positioned to engage the tangential extension 68.

In operation, the method for operating the actuating assembly 20 to drive the motor 24 to cinch a closure panel 14 begins by driving the motor 24 in a cinching direction 88 when the striker bar 18 is received in the primary detent 82 and the pawl 76 engages the secondary detent 84. The rotation of the motor 24 drives the transmission 28 which, in turn, drives the sector gear 58. As the sector gear 58 rotates about the third axis of rotation 72, the drive pin 70 engages a cinch surface 83 and rotates the ratchet 30 until pawl 76 engages the primary detent 82 and locks the striker bar 18 in the primary detent 82. The abutment surface 78 of the pawl 76 prevents the ratchet 30 from counter-rotating, locking the latch 16 in a cinched position.

Once the ratchet 30 is secured by the pawl 76, current to the motor 24 is reversed allowing the motor 24 to return to its park position by rotating the motor 24 in a direction 90 opposite the cinching direction 88. The ratchet 30 is not affected by this back driving motion because it includes an opening 92 that allows the sector gear 58 to move without the drive pin 70 engaging the ratchet 30. In other words, the opening 92 allows a lost motion.

Figure 5:
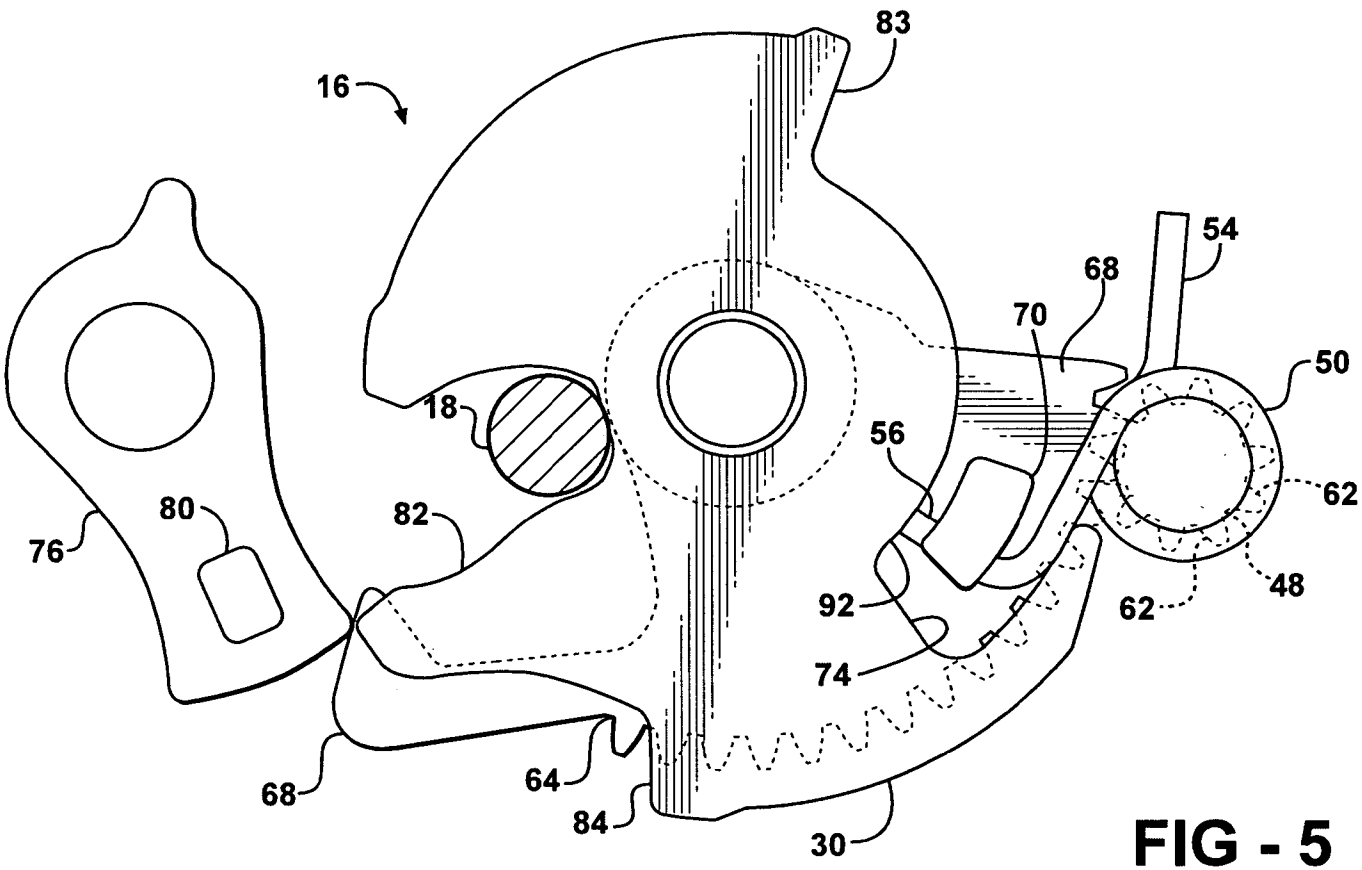

To release the closure panel 14, the latch 16 must be unlatched. To do so, the motor 24 is rotated in a release direction 94 that is the same direction as the return direction 90. The release direction 94 is, however, started from the park position. Therefore, the release direction 94 forces the sector gear 58 to drive the drive pin 70 into the drive surface 74 of the ratchet 30. This forces the tangential extension 68 of the ratchet 30 to engage and force the pawl 76 out of abutting engagement with the primary detent 82 allowing the bias of the ratchet 30 to counter-rotate. Upon the release of the pawl 76, the sector gear 58 holds the abutment surface 78 of the pawl 76 out of the path of the secondary detent 84 of the ratchet 30 allowing the ratchet 30 to move to the unlatched position (FIG. 5). When this occurs, a signal is directed to the motor 24 to cease rotation. Power is removed from the motor 24 allowing the spring 50 to back drive the transmission 28 to return the transmission 28 and the motor 24. When power is removed, the only force applied to the sector gear 58 is the spring 50, which is in the expanded condition. Therefore, the second end 56 of the spring 50 forces the drive pin 70 and the sector gear 58 back when the spring 50 is allowed to compress to its steady-state condition. This returns the motor 24 to its park position.

The invention has been described in an illustrative manner. It is to be understood that the terminology, which has been used, is intended to be in the nature of words of description rather than of limitation. Many modifications and variations of the invention are possible in light of the above teachings. Therefore, within the scope of the appended claims, the invention may be practiced other than as specifically described.

What is claimed:

1. An actuating assembly for a closure panel of a motor vehicle, said actuating assembly comprising:

a ratchet engageable with a striker of the closure panel, said ratchet including a cinch surface and a drive surface defining an opening therebetween;

a sector gear movable in opposing first and second directions, said sector gear including a drive pin extending out perpendicularly therefrom and received within said opening of said ratchet for selective engagement with said cinch and drive surfaces thereof;

a motor spaced apart from said sector gear, said motor including an output shaft extending out therefrom, said output shaft drivable in cinching and releasing directions from a park position;

a transmission operatively connected between said output shaft and said sector gear for moving said sector gear in said first direction in order to drive said drive pin against said cinch surface of said ratchet to lock the striker within said ratchet when said output shaft is drivable in said cinching direction and for moving said sector gear in said second direction in order to drive said drive pin against said drive surface of said ratchet to release the striker from said ratchet when said output shaft is drivable in said releasing direction; and a spring having one end disposed within said opening and engageable with said drive pin for forcing said sector gear into movement in said first direction in order to return said motor to said park position after said motor is turned off and said output shaft has moved in the releasing direction.

2. An actuating assembly as set forth in claim 1 wherein said drive pin travels within said opening relative to said ratchet after the striker is locked within said ratchet in order to return said motor to said park position.

3. An actuating assembly as set forth in claim 2 wherein said spring is a coil that is expanded by said drive pin as said drive pin is driven against said drive surface of said ratchet.

4. An actuating assembly as set forth in claim 3 including a belt extending between said output shaft and said transmission.

5. An actuating assembly for cinching and releasing a striker bar fixedly secured to a closure panel of a motor vehicle, said actuating assembly comprising:

a ratchet engageable with the striker bar of the closure panel;

a sector gear movable in opposing first and second directions, said sector gear including a drive pin extending out perpendicularly therefrom for selectively engaging said ratchet;

a motor including an output shaft drivable in cinching and releasing directions from a park position;

a transmission operatively connected between said output shaft and said sector gear, said transmission moving said sector gear in said first direction when said output shaft is driven in said cinching direction in order to drive said drive pin against said ratchet to lock the striker within said ratchet, said transmission moving said sector gear in said second direction when said output shaft is driven is said releasing direction in order to drive said drive pin against said ratchet to release the striker from said ratchet; and a spring having a first end operably connected to said transmission and a second end engageable with said drive pin, said drive pin expanding said spring as said sector gear moves in said second direction to drive said drive pin against said ratchet to release the striker, said spring forcing said sector gear into movement in said first direction after said motor is turned off in order to return said motor to said park position.

6. An actuating assembly as set forth in claim 5 including a belt extending between said output shaft and said transmission.

* * * * *